US005261578A

United States Patent [19]

Monahan

[11] Patent Number: 5,261,578

[45] Date of Patent: Nov. 16, 1993

[54] BOW MAKING APPARATUS AND METHOD

[76] Inventor: Terry Monahan, 4146 N. 94th St., Wauwatosa, Wis. 53222

[21] Appl. No.: 969,529

[22] Filed: Oct. 30, 1992

Related U.S. Application Data

[63] Continuation of Ser. No. 849,484, Mar. 11, 1992, abandoned.

[51] Int. Cl.[5] ..... A41H 43/00

[52] U.S. Cl. ..... 223/46; 28/147

[58] Field of Search ..... 223/46, 44; 28/147, 28/149; 428/4, 5; 493/955

[56] References Cited

U.S. PATENT DOCUMENTS

| | | | |
|---|---|---|---|
| 2,335,053 | 11/1943 | Gluck . | |
| 2,521,863 | 9/1950 | Mertz | 223/46 |
| 3,236,426 | 2/1966 | Kerrigan et al. | 223/46 |
| 3,409,190 | 11/1968 | Bachman et al. . | |
| 3,428,227 | 2/1969 | Cavoli . | |
| 3,485,422 | 12/1969 | Egid | 223/46 |
| 3,545,656 | 12/1970 | Jacobson | 223/46 |
| 4,007,860 | 2/1977 | Glesman | 223/46 |
| 4,714,182 | 12/1987 | Hecht . | |
| 5,072,865 | 12/1991 | Lyons | 223/46 |

*Primary Examiner*—Clifford D. Crowder
*Assistant Examiner*—Amy Brooke Vanatta
*Attorney, Agent, or Firm*—Andrus, Sceales, Starke & Sawall

[57] ABSTRACT

An apparatus for automatically forming and tying a decorative bow includes a mechanism for delivering ribbon from a spool and cutting a piece of ribbon therefrom, a transfer mechanism for picking up the ribbon piece and carrying it to a forming station where the ends of the ribbon piece are folded over one another and gathered on the centerline by squeezing the overlapping portions together, and a tying mechanism which delivers a piece of tie wire to the gathered center portion of the bow, wraps it there around, and twists the ends of the tie together to secure the finished bow. An identical pair of folding, gathering and tying mechanisms is served by a centrally positioned ribbon cutting and delivery mechanism, the latter operating on an overhead gantry which simultaneously serves both stations.

12 Claims, 8 Drawing Sheets

FIG. 3
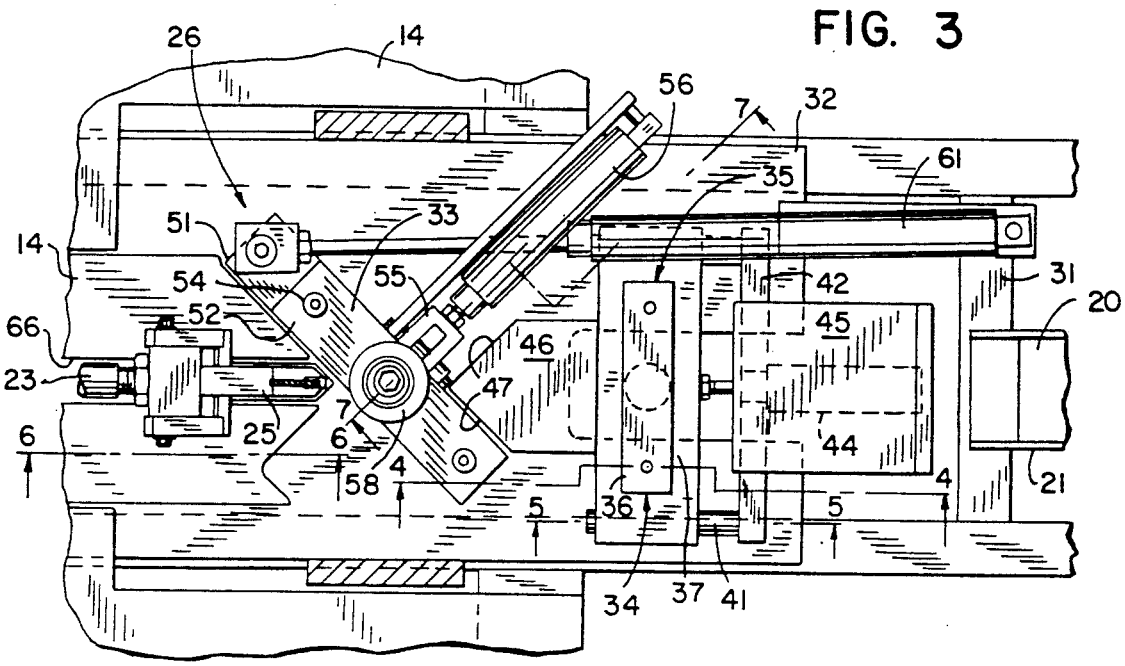
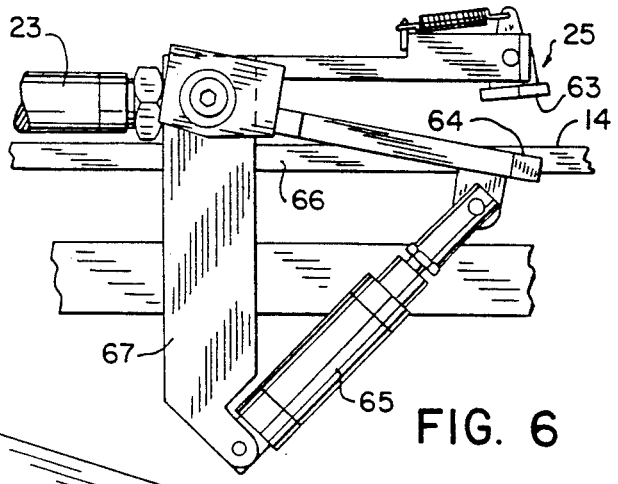
FIG. 6
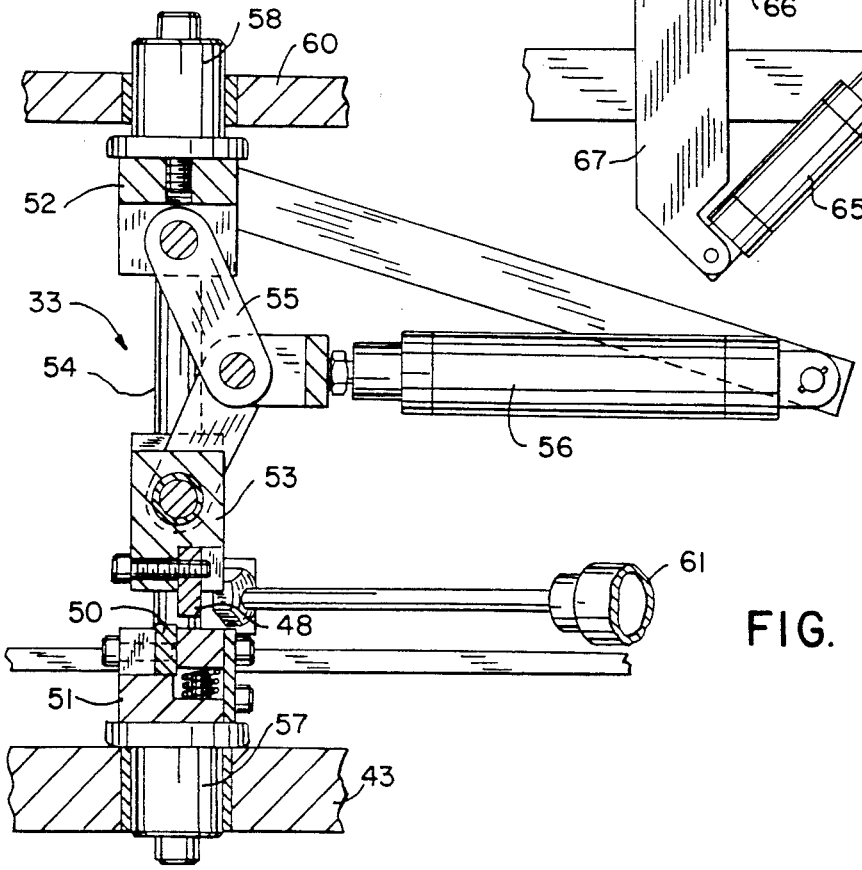
FIG. 7

FIG. 24
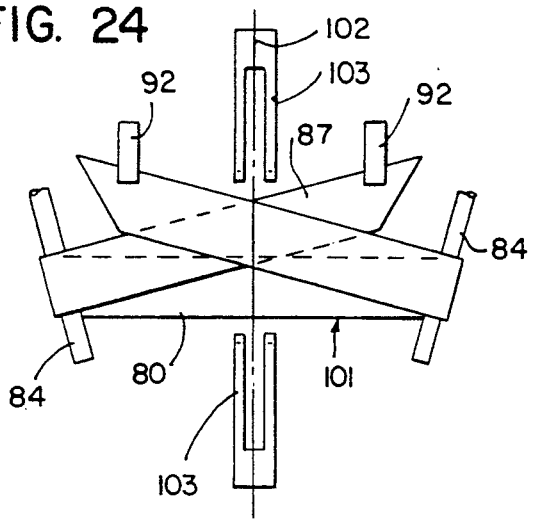
FIG. 25
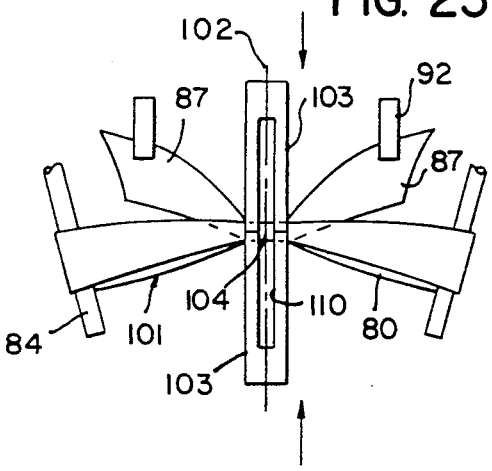
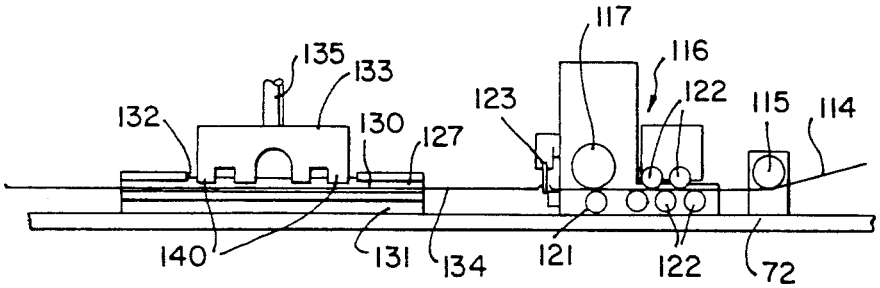
FIG. 26
FIG. 27
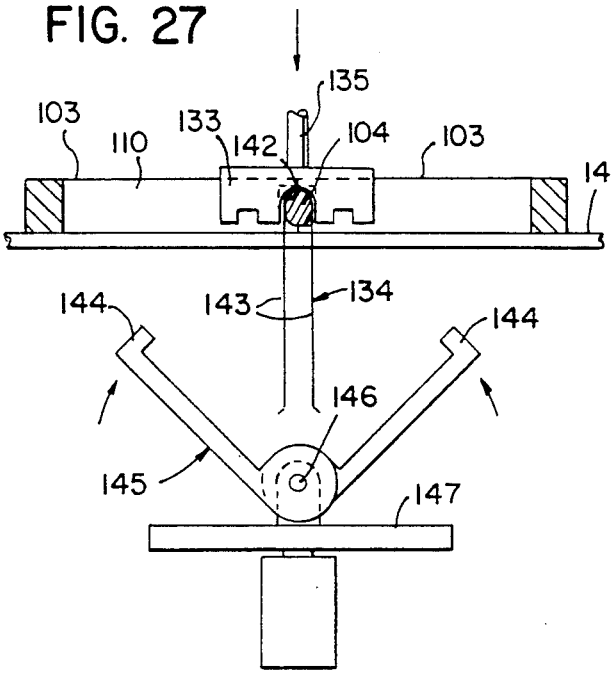
FIG. 28
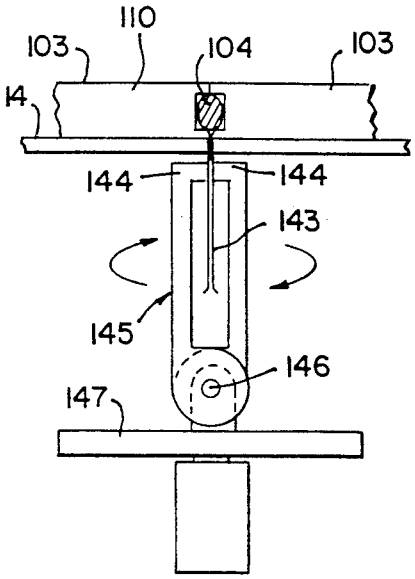

BOW MAKING APPARATUS AND METHOD

This is a continuation of application Ser. No. 07/849,484, filed Mar. 11, 1992, now abandoned.

BACKGROUND OF THE INVENTION

The present invention relates to an apparatus for making bows and, more particularly, to a machine for forming and tying decorative bows, the operation of which is fully automatic.

Decorative bows of the type in which the ends of a piece of ribbon are folded over one another and across the center portion of the piece with the ends and center portion subsequential gathered or pinched and fastened with a wire tie are well known in the art. The wire tie is typically provided with extended ends by which the finished bow may be suitably attached to a package, decoration, or the like.

Decorative bows are typically folded and tied manually with certain relatively rudimentary fixtures often used to assist in holding the ribbon piece for folding and/or attaching the wire tie. U.S. Pat. No. 3,428,227 shows a fixture including a plurality of extendable and retractable rods around which a piece of ribbon is manually folded to hold the ribbon in tension until the center can be gathered and fastened. U.S. Pat. No. 4,714,182 discloses a jig for use with a ribbon wrapping machine in which a pair of bow holding rods diverge to cause a slack in the folded ribbon allowing the center to be gathered and tied. U.S. Pat. No. 2,335,053 shows a device for winding a continuous length of ribbon on a rotary mandrel in which sections of the ribbon are subsequentially gathered and manually tied to form a plurality of bows.

U.S. Pat. No. 3,409,190 discloses a machine for automatically folding and fastening simple bows by folding the opposite ends of a piece of ribbon sequentially to provide a bow preform utilizing a ribbon carriage moving in a linear path past stationary deflecting and folding fingers. The bow preform is not gathered, but rather fastened centrally with a button or rivet type fastener.

SUMMARY OF THE INVENTION

In accordance with the present invention, a fully automatic apparatus for forming and tying a decorative bow includes a ribbon delivery and cutting mechanism, a ribbon transfer mechanism, a ribbon folding and gathering mechanism, and a ribbon tying mechanism which are coordinated to operate together in a continuous and fully automatic manner to produce simple two-loop bows tied in the center with a twisted wire tie. In the preferred embodiment, a single ribbon delivery and cutting mechanism alternately provides ribbon pieces to two opposite pairs of mechanisms, each including a folding and gathering mechanism and a ribbon tying mechanism.

The ribbon delivery and cutting mechanism includes means for drawing one end of a strip of ribbon material from a ribbon material source, such as a roll or spool, and means for cutting a piece of ribbon material of selected length from the end of the strip. The ribbon transfer mechanism includes means for releasably holding the piece of ribbon material by its ends over the top of a table in a manner to relax the ribbon strip lengthwise and form a downwardly sagging center portion, and for delivering the ribbon piece to the folding and gathering mechanism.

The folding and gathering mechanism includes a pair of spaced holddown members which are extendable over the sagging center portion to hold it against the table top inwardly of the opposite free ends of the piece. Means are also provided for stripping the held ends of the ribbon material piece from the end holding means and for folding each end over its respectively adjacent holddown member and the center portion of the piece with one end of the ribbon piece overlying the other, the ribbon preferably disposed in generally opposite directions and at an angle with respect to the length of the ribbon. Means are provided for grasping the folded ends of the ribbon to act with the holddown members to hold the folded piece in tension for forming a bow preform. Means are also provided for gathering the bow preform by squeezing the same horizontally over the table top on a centerline generally perpendicular to the length of the center portion of the preform to form a short pinched portion of material.

The ribbon tying mechanism includes means for feeding one end of a strip of tie wire from a tie wire source, means for cutting a short piece of tie wire from the end of the strip, means for wrapping the tie wire piece around the pinched portion of ribbon material in a manner to bring the ends of the wire tie towards one another beneath the table top in the form of an inverted U-shape, and means for clamping and turning the legs of the wire piece to twist them together and hold the pinched portion tightly in place to form a completed bow.

The ribbon transfer mechanism preferably comprises a gantry platform which is positioned above the table top and mounted for linear reciprocal horizontal movement in the direction transverse to the length of the ribbon material piece. The material piece is releasably held by a gantry arm attached to and movable with the platform, with the gantry arm positioned parallel to the length of the piece of material and having vacuum pick-up heads on opposite ends which are mounted for vertical reciprocal movement over the cutting mechanism to pick up and hold the piece of ribbon material above the table top. The vacuum pick-up heads are movable along the gantry arm toward each other to cause the ribbon piece to collapse and form the downwardly sagging center portion.

In the preferred embodiment including opposite pairs of mechanisms, each including a folded and gathering mechanism and a ribbon tying mechanism, the material cutting means includes a knife which is alternately positionable with each opposite directional movement of the gantry arm to cut the strip of ribbon material on alternately biased cut lines to accommodate the generally alternately opposite directions in which the bow preforms are made.

The means for holding the center portion of the ribbon material piece includes a pair of fingers having axes rotatable in a vertical plane between and upwardly angled position for receiving the sagging ribbon piece and a lower horizontal folding position, the fingers being relatively movable with respect to the means for releasably holding the ribbon material to override the sagging center portion of the material when in the receiving position and to hold that center portion against the table in the holding position. The fingers are preferably positioned to converge in the direction of their distal ends so they lie at acute angles with respect to the length of the ribbon material piece. The means for stripping and folding the ribbon includes a pair of horizontally reciprocable folding arms, each of which is positioned to move over and generally transversely of one holddown finger and to strip one end of the ribbon material piece from the holding means and to carry that end toward the proximal end of the other holddown finger. The grasping means includes a clamping jaw for each folding arm, each jaw positioned adjacent the proximal end of a holddown finger to receive and clamp the free end of the ribbon material piece which is carried by the folding arm with which it cooperates.

The means for gathering the bow preform includes a pair of opposed gathering members which are positioned to move along the table top on the line of symmetry through the bow preform to a closed position to squeeze the material therebetween and form the pinched portion. One of the gathering members includes a retaining member which is movable on the line of symmetry independently of the gathering member to override and vertically contain the preform prior to movement of the gathering members to the closed position.

In accordance with the preferred embodiment, the tie wire includes a ferrous wire core and the ribbon tying mechanism comprises a magnetic pick-up for holding the wire tie piece above the pinched portion of the bow preform so that the wire tie is disposed in the vertical plane through the line of symmetry through the bow preforms. The magnetic pick-up is movable vertically downward to carry the wire tie piece between the gathering means and into rapid contact with the pinched portion. The magnetic pick-up preferably includes a centrally disposed U-shaped forming notch into which the wire tie piece is forced in response to vertical downward movement into contact with the pinched portion.

In accordance with the basic method of the present invention, a decorative bow is formed and tied by drawing one end of a strip of ribbon material from a source, cutting a piece of ribbon material from the end of the strip, holding the piece of ribbon material lengthwise by its ends over the top of a table with the strip relaxed to form a downwardly sagging center portion, separately holding the center portion against the table top with a pair of holddown members, stripping the ends of the material piece and folding each end over its respectively adjacent holddown member in generally opposite directions and at acute angles with respect to the length of the ribbon, grasping the folded ends to hold the folded piece in tension, gathering the folded piece at its center by squeezing the piece horizontally over the table top on a line generally perpendicular to the length of the ribbon to form a short pinched portion of material, drawing one end of a strip tie wire from a source, cutting a piece of tie wire from the end of the strip, folding the tie wire pieces around the pinched portion of the ribbon material by bending the ends of the wire piece downward beneath the table top in an inverted U-shape, clamping the legs of the U-shaped wire piece together with clamping jaws positioned beneath the table top, and turning the clamping jaws on a vertical access to twist the legs of the wire piece together and hold the pinched portion tightly in place.

BRIEF DESCRIPTION OF THE DRAWINGS

FIG. 3 is an enlarged top plan view of the apparatus shown in FIG. 2, showing details of the ribbon delivery and cutting mechanism.

FIGS. 4–7 are enlarged vertical sectional details of various portions of the apparatus shown in FIG. 3.

FIGS. 16–28 are sequential schematic views of the operation of the various mechanisms comprising the apparatus of the present invention.

DETAILED DESCRIPTION OF THE PREFERRED EMBODIMENT

Figure 1:
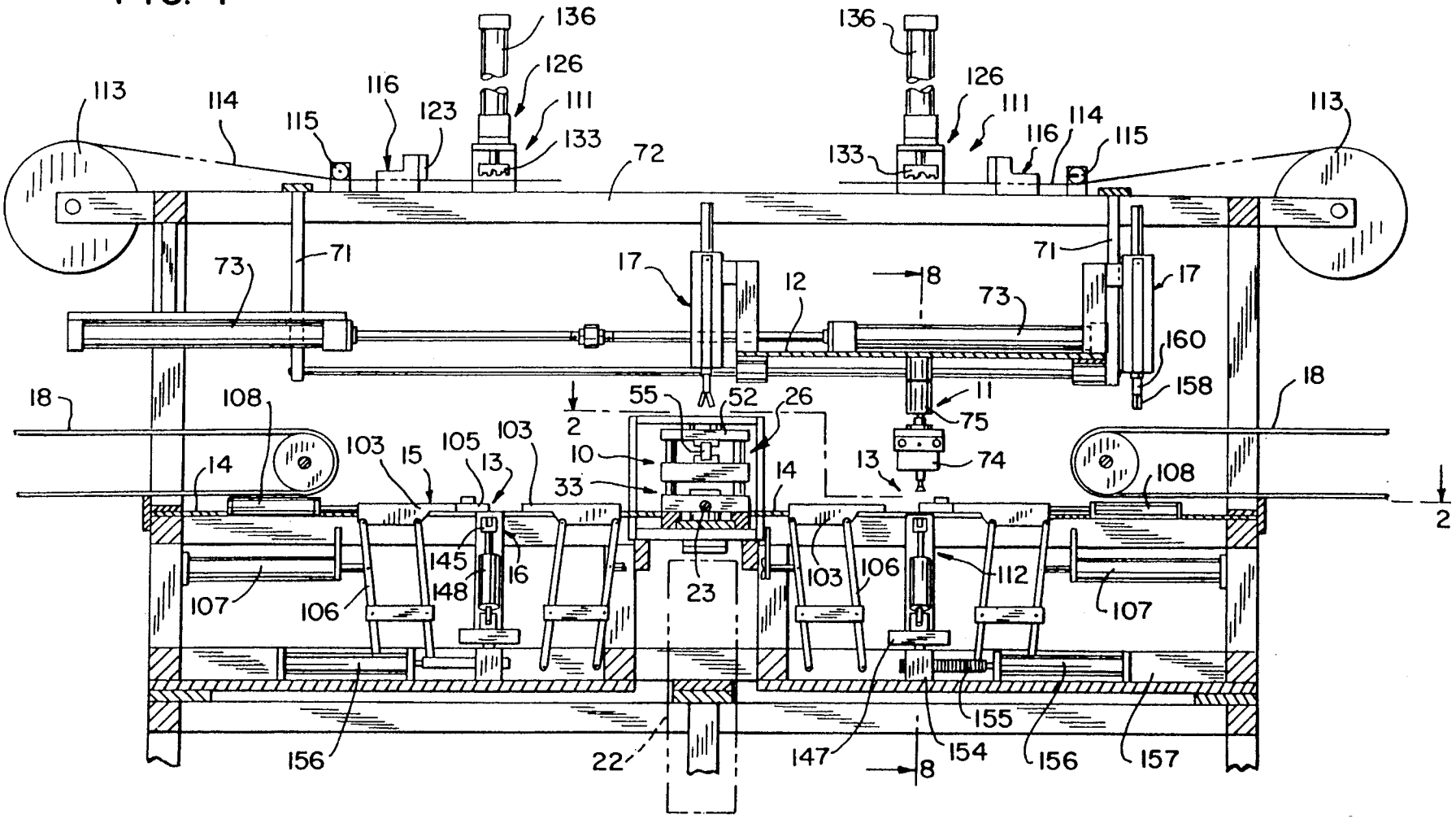
FIG. 1 is a vertical side elevation of the preferred embodiment of the apparatus of the present invention.

The general arrangement of the bow forming and tying apparatus of the present invention is shown in the side elevation view of FIG. 1. In the preferred embodiment shown, identical bows are alternately formed and tied in two identical stations disposed on opposite sides of a centrally positioned ribbon delivery and cutting mechanism 10 A ribbon transfer mechanism 11 includes a gantry platform 12 supported above the apparatus for alternating reciprocal horizontal movement between the central ribbon delivery and cutting mechanism 10 and the oppositely located bow forming and tying stations 13.

Figure 2:
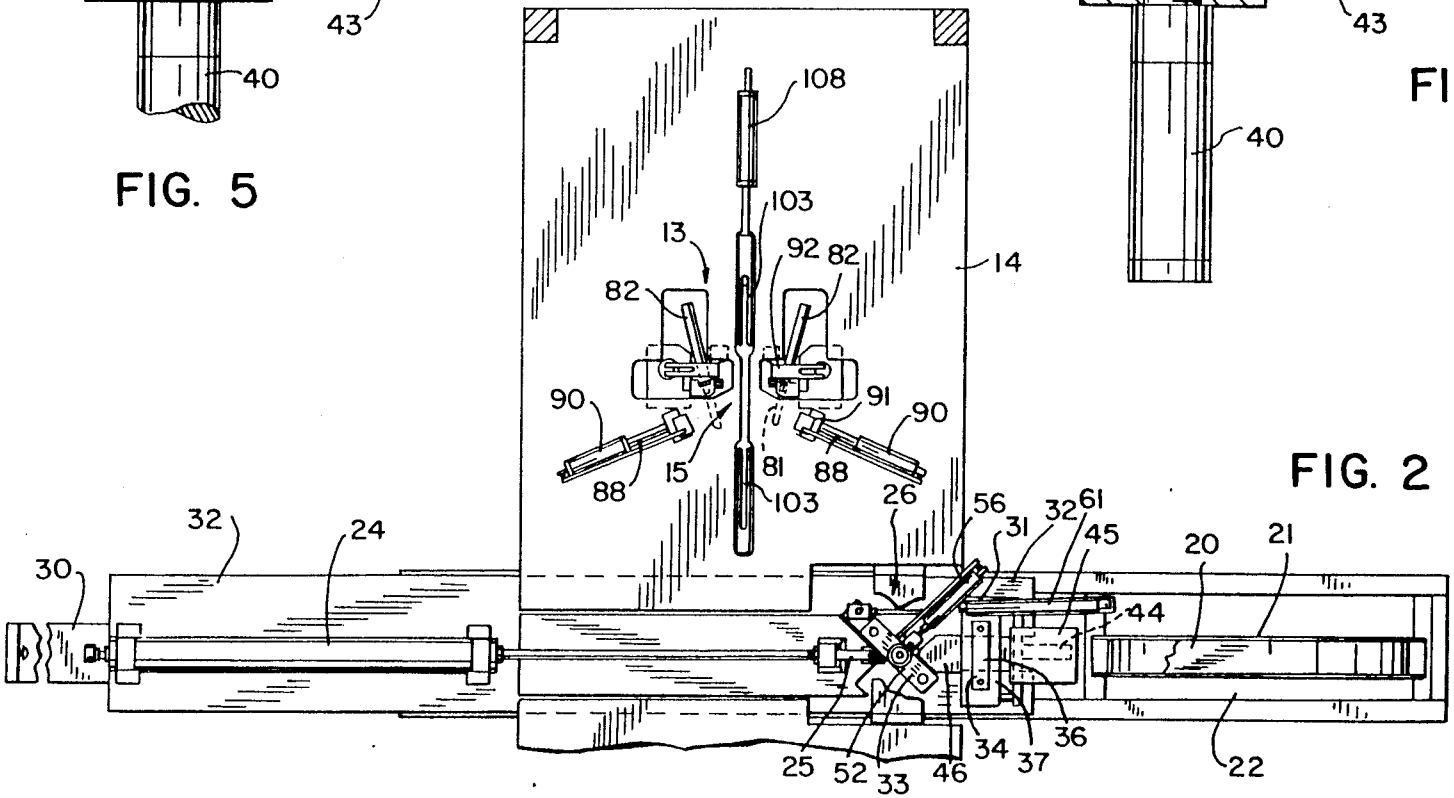
FIG. 2 is a top plan view of a portion of the apparatus of FIG. 1 taken on line 2—2 of thereof.

The bow material is delivered and cut and the cut material pieces delivered for processing generally along the top of a horizontal table 14. The table is provided with suitable openings to accommodate the various processing mechanisms, as will be described. Referring to FIG. 2, each station 13 includes a ribbon folding and gathering mechanism 15 and a ribbon tying mechanism 16. Finally, a pair of pick and place robots 17 are mounted on opposite ends of the gantry platform 12 to pick up the bows completed at each forming and tying station 13 and deliver them to an associated discharge conveyor 18.

Referring also to FIGS. 3–7, the ribbon delivery and cutting mechanism 10 operates to draw one end of a strip of ribbon material 20 from a continuous source such as a spool or reel 21 mounted in a ribbon delivery housing 22 centered on the apparatus and mounted offset to one side thereof. The rod end 23 of a ribbon pulling cylinder 24 is mounted horizontally at approximately the height of the table 14 to move reciprocally across the table to draw the free end of the ribbon material 20 from the reel 21 for cutting by a ribbon cutting assembly 26. The rod end 23 of the ribbon pulling cylinder is provided with a ribbon clamp 25 which holds the ribbon end for withdrawal as the cylinder rod is retracted and releases the ribbon when a selected length is severed by the ribbon cutting assembly 26 to form a ribbon material piece 27 (see also FIGS. 16 and 17). The ribbon pulling cylinder 24 is attached to a cross supporting structure 32 which includes an adjustment mechanism 30 by which the position of the cylinder 24 can be adjusted in the direction of its axis to selectively vary the length of ribbon material 20 drawn from the reel 21 Similarly, the ribbon cutting assembly 26 is mounted on an adjustably positionable knife platform 31 for horizontal movement in the same direction as the ribbon pulling cylinder 24 so that whatever the selected length of the ribbon material piece 27 is (within the limits of machine adjustment), the ribbon piece 27 will always be centered on the centerline 29 of the table 14 for pick up and delivery to one of the forming and tying stations 13. The centerline 29 of the table also defines the line of symmetry 102 through the ribbon piece 27 and bow preform 101, as will be described hereinafter.

Figure 4:
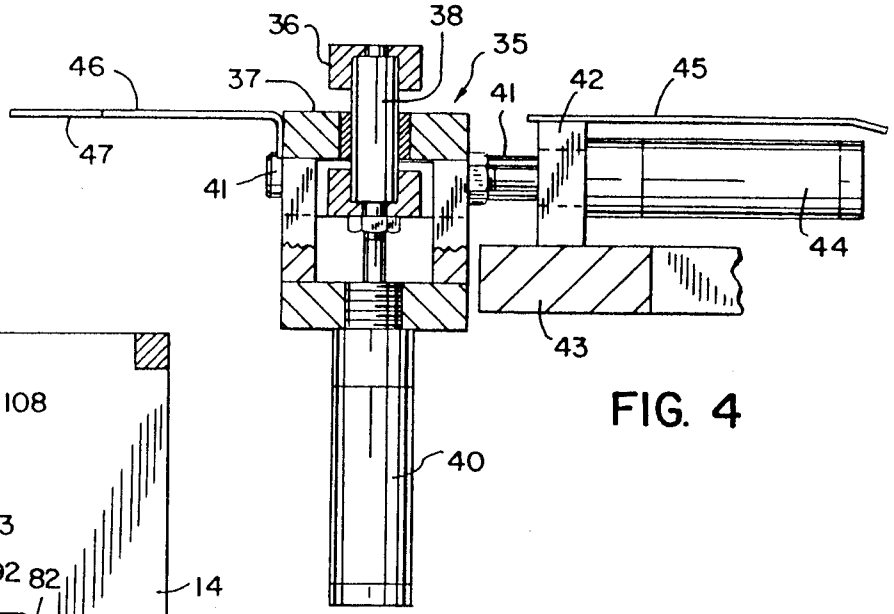
Figure 5:
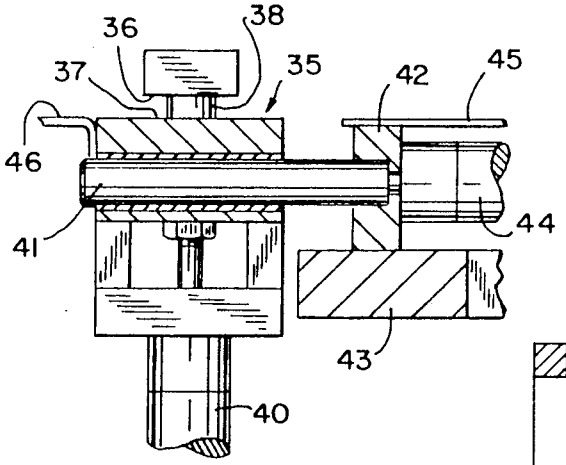

As best shown in FIGS. 3-5, the cross supporting structure 32 supports the cylinder adjusting mechanism 30 on one side of the table 14 and a ribbon-cutting knife assembly carriage 31 generally on the opposite side of the table. The entire cross supporting structure 32 is movable in a transverse direction with respect to the table (i.e. axially of the ribbon pulling cylinder 24) so the length of the ribbon material piece 27 may be selectively varied and still maintained on the centerline 29 of the table and of the forming and tying stations to which it is transferred for forming. The knife assembly carriage 31 includes a cutting knife assembly 33 and a ribbon end clamping and advancing assembly 34. The latter operates to grasp and move the freshly cut end of the ribbon material 20 horizontally into the open jaws of the ribbon clamp 25 on the end of the ribbon pulling cylinder 24. The ribbon end clamping and advancing assembly 34 includes a clamping head 35 having upper and lower jaws 36 and 37, respectively, between which the advancing ribbon material 20 moves with the lower jaw 37 positioned and held at the level of the table top 14. The upper jaw moves vertically between open and closed positions on a pair of spaced vertical guide pins 38 which are slidably mounted in the lower jaw 37. Open and closing movement of the upper jaw 36 is provided by a vertically disposed clamp cylinder 40. The entire clamping head 35 is mounted for horizontal reciprocating movement on a pair of horizontal guide pins 41 which are stationarily mounted on the knife assembly carriage 31 to a cross member 42 mounted on a carriage-supporting base member 43. A clamping head advancing cylinder 44 is also mounted on the cross member 42 with its rod and bearing against the clamping head 35. Extension of the advancing cylinder 44 causes the clamping head (when closed to clamp the ribbon end) to carry the ribbon end horizontally toward the ribbon clamp 25. A ribbon supporting deck plate 45 is attached to the cross member 42 at the level of the table top to support the ribbon material being fed between the clamping head jaws 36 and 37. Similarly, the ribbon material is supported on the other side of the jaws by a deck plate 46 attached to the clamping head 35 having a free end cut with mutually perpendicular biased edges 47. The biased edges 47 accommodate the indexing of the cutting knife assembly 33 as will be described.

Referring also to FIGS. 6 and 7, the cutting knife assembly 33 includes a vertically movable upper shear blade 48 and a stationary lower shear blade 50. The lower shear blade 50 is mounted on a lower support member 51 which is in turn attached by a pair of horizontally spaced vertically extending slide pin 54 to an upper support member 52. The upper shear blade 48 is mounted on an intermediate support member 53 which, in turn, is mounted for vertical sliding movement on the slide pins 54. The upper support member 52 is connected to the intermediate support member 53 by an articulating toggle mechanism 55 which is operated by a cutting knife cylinder 56 to cause downward cutting movement of the upper shear blade 48 against the lower shear blade 50. The lower and upper support members 51 and 52 include axially aligned lower and upper trunions 57 and 58 which mount the entire cutting knife assembly 33 in the base member 43 and an upper base member 60, respectively. Rotation of the cutting knife assembly 33 on the axis of the trunions 57,58 is provided by a knife indexing cylinder 61 having its rod end attached to one end of the lower support member 51 and the cylinder end attached to the rearward end of the knife assembly carriage 31.

Figure 16:
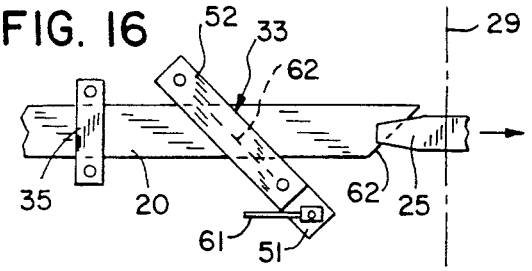
Figure 17:
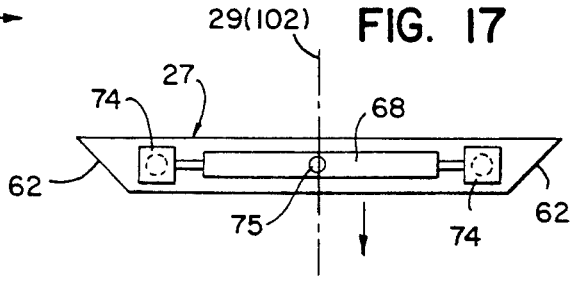

Operation of knife indexing cylinder 61 rotates the cutting knife assembly 33 90° between alternate cutting positions which provide alternating biased cut lines 62 disposed generally at angles of 45° to the ribbon material edges (see FIGS. 16 and 17). As soon as a ribbon material piece 27 has been cut on a biased cut line 62 and the ribbon piece has been transferred out of the cutting mechanism 10, clamping head 35 which has remained closed on the end of the ribbon material 20 fed from the reel 21 is advanced horizontally toward the ribbon pulling cylinder 24 which, in turn, is extended from its retracted position to carry the open ribbon clamp 25 across the table top to receive the free end of the ribbon material fed over the deck plate 46 and between the open blades of the cutting knife assembly 33. At the same time, the knife indexing cylinder 61 is operated to rotate the cutting knife assembly 33 90° to provide the opposite biased cut line 62 for the next ribbon piece. Referring to FIG. 6, the ribbon clamp 25 includes a generally stationary upper jaw 63 and a pivotal lower jaw 64, the latter operable by ribbon clamp cylinder 65 to close against the upper jaw and clamp the ribbon material end therebetween. The upper jaw 63 may be pivotally mounted with an appropriate spring bias which holds the upper jaw in a slightly angled position to provide a better lead in for the ribbon material being fed by the moving clamping head 35. The ribbon pulling cylinder rod 23 is positioned just above the top of the table 14 which is provided with an open slot 66 to accommodate sliding movement of the lower jaw 64, ribbon clamp cylinder 65 and its associated mounting bracket 67.

The ribbon material piece 27 provided with oppositely oriented biased cut lines 62 is moved from the cutting mechanism 10 to one of the forming and tying stations 13 by a gantry arm 68 mounted on the gantry platform 12. The gantry platform is supported above the table 14 for horizontal movement along a pair of gantry guide rods 70. The guide rods 70 are attached at their ends to vertical mounting brackets 71 which, in turn, are suspended from an upper frame member 72. Reciprocal horizontal movement of the gantry platform and attached gantry arm 68 is provided by a pair of opposed gantry cylinders 73.

Figure 8:
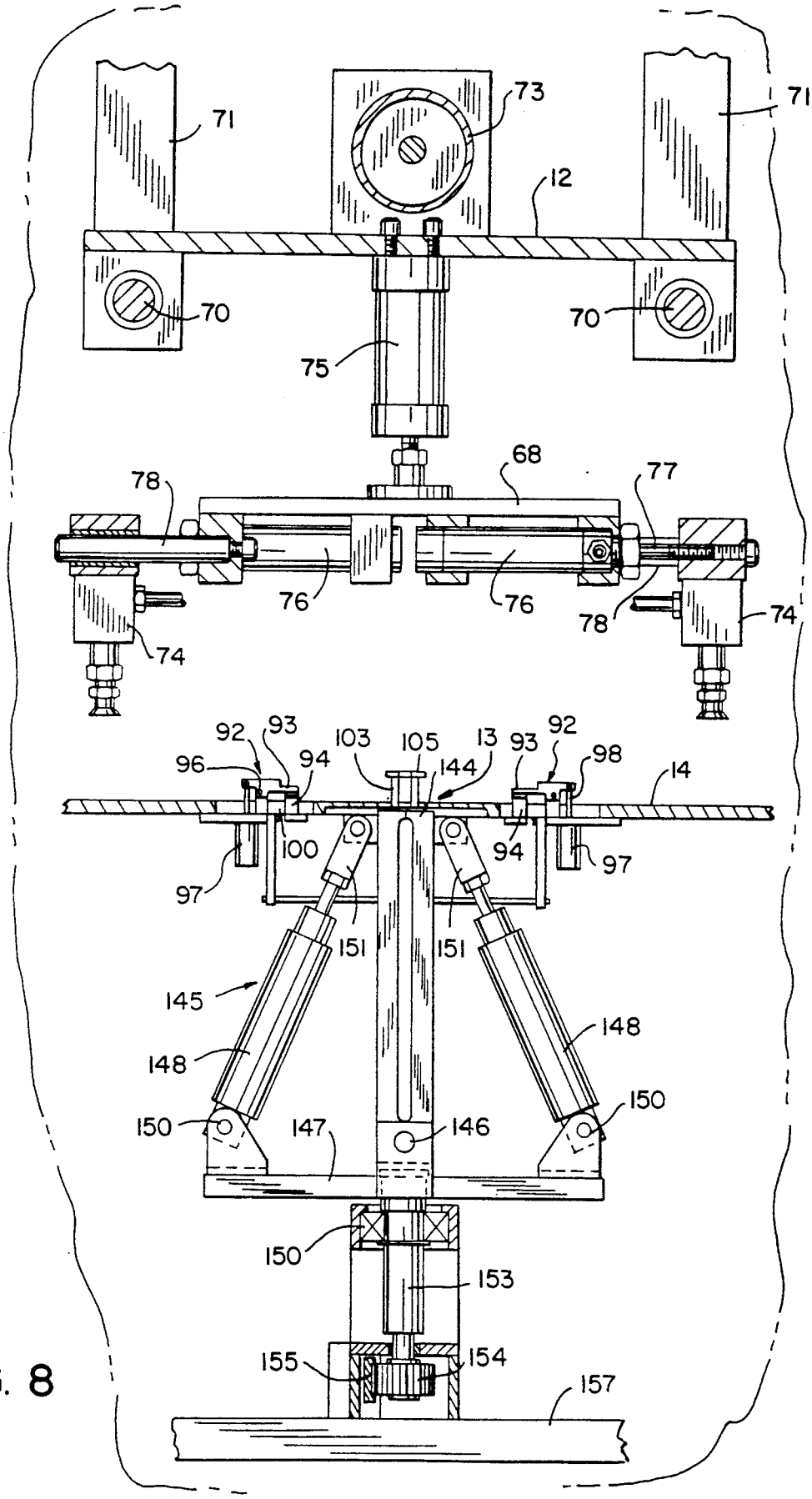
FIG. 8 is a vertical sectional detail taken on line 8—8 of FIG. 1.
Figure 18:
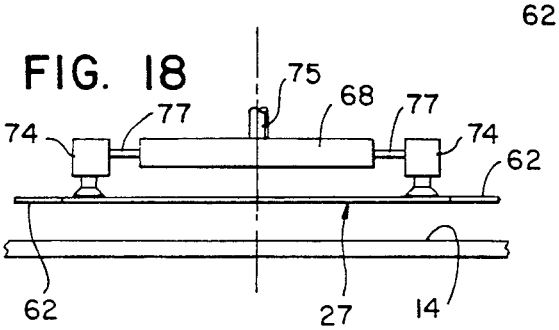
Figure 19:
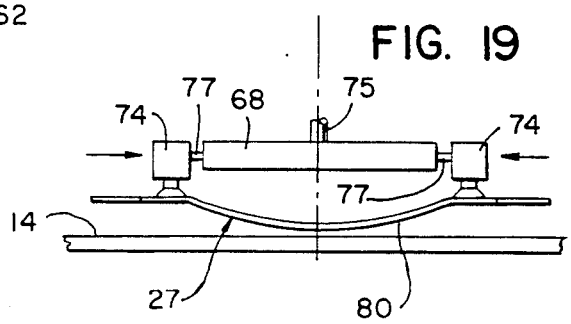

The gantry arm 68 has a pair of vacuum pick-up ends 74 attached to opposite ends, as is best seen in FIG. 8. The gantry arm is supported from the gantry platform 12 by a vertically positioned gantry arm cylinder 75 by which the gantry arm may be moved vertically downwardly to cause the ribbon material piece 27 to be picked up the pick-up heads 74 when the gantry arm is positioned above the cutting mechanism. The piece of cut ribbon material 27 is picked up off the table by the vacuum heads 74 and the gantry arm cylinder 75 is immediately retracted to raise the arm to its upper position. From this position, one of the gantry cylinders 73 is actuated to move the gantry platform and gantry arm toward one of the forming and tying stations 13. The vacuum heads are mounted on the gantry arm 68 for horizontal movement toward and away from one another by operation of oppositely extending pick-up head cylinders 76 attached to the gantry arm and having their rod ends 77 attached to the vacuum pick-up heads 74. The heads 74 are retained against rotation by slide pins 78 mounted on the ends of the gantry arm and journaled in the pick-up heads. As is shown schematically in FIGS. 18 and 19, movement of the vacuum heads toward one another by retracting the pick-up head cylinders 76 causes the ribbon material piece 27 to relax or collapse lengthwise to form a downwardly sagging center portion 80.

Figure 12:
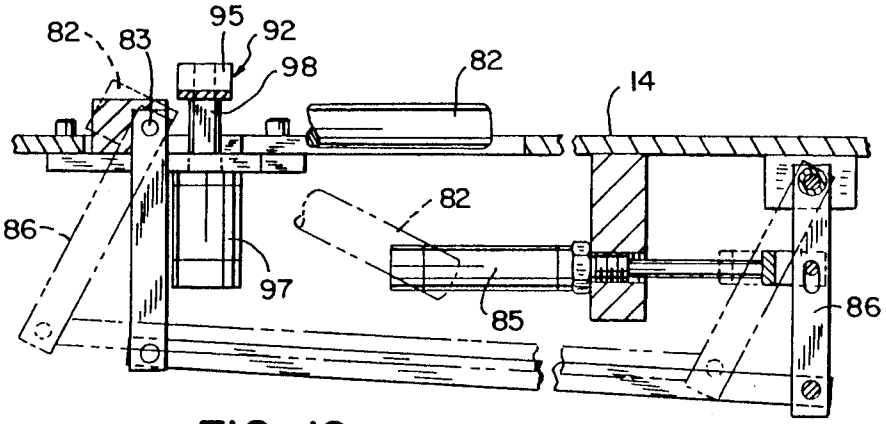
Figure 20:
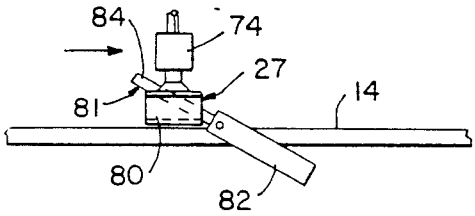
Figure 21:
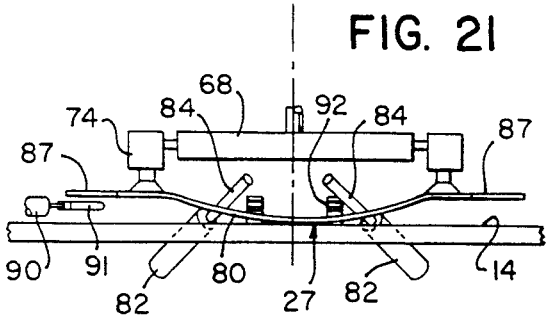
Figure 22:
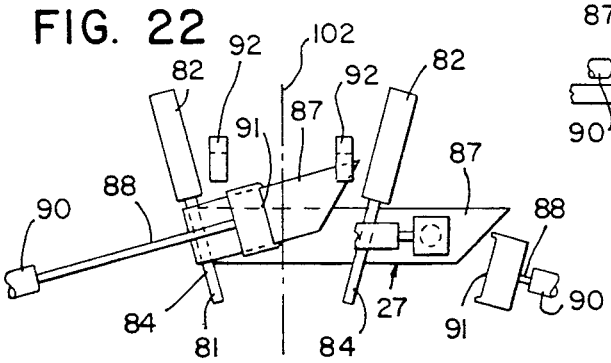
Figure 23:
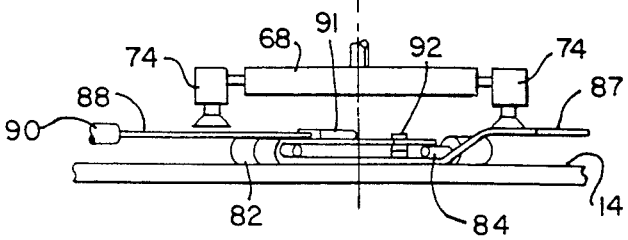

The folding and gathering mechanism 15 at the forming and tying station 13 includes a pair of holddown members comprising a pair of extendible fingers 81 which are preferably the rods of a pair of holddown cylinders 82. Each of the holddown cylinders 82 is rotatably mounted on a cylinder pivot 83 at approximately the level of the table top 14 so that the cylinder 82 and the extended holddown finger rods 84 are rotatable in a vertical plane between and upwardly angled ribbon material receiving position (see also FIGS. 20 and 21) and a lower horizontal holding position (see also FIGS. 22 and 23). The holddown cylinders 82 and their integral holddown rods 84 are further positioned on their respective cylindrical pivots to converge in the direction of the distal ends of the rods as shown. As the ribbon material piece 27 is carried on the gantry arm toward the forming and tying station 13, the holddown cylinders are pivoted upwardly to the material receiving position and the holddown rods 84 are extended. The sagging center portion 80 of the ribbon material piece 27 passes under the ends of the holddown rods 84 thereby allowing the same to really override the ribbon. Movement of the gantry arm 68 stops with the ribbon at the forming and tying station 13 and the holddown cylinders 82 are caused to pivot to the horizontal holding position, whereby the holddown rods 84 press the sagging center portion 80 of the ribbon downwardly and hold the same against the top of the table 14. Referring particularly to FIG. 12, the holddown cylinders 82 are rotated between their material receiving positions and holding positions by operation of a holddown pivot cylinder 85 mounted beneath the table to operatively engage an articulating linkage 86 connected to the cylinder pivots 83. As shown, extension of the holddown pivot cylinder 85 rotates the holddown cylinders 82 to their horizontal holddown positions and retraction of the holddown pivot cylinder causes the pivot cylinders 82 to rotate to the upwardly extending receiving positions.

Figure 9:
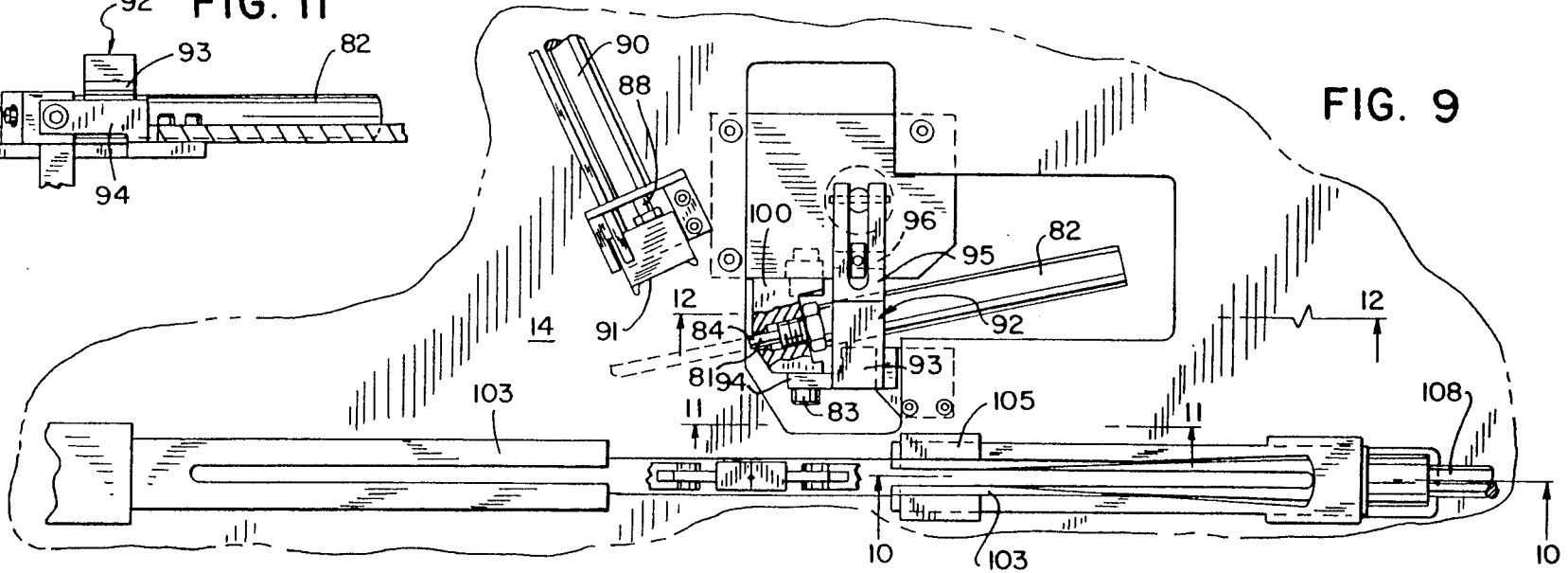
FIG. 9 is an enlarged detail of FIG. 2 showing details of the ribbon folding and gathering mechanism.
Figure 11:
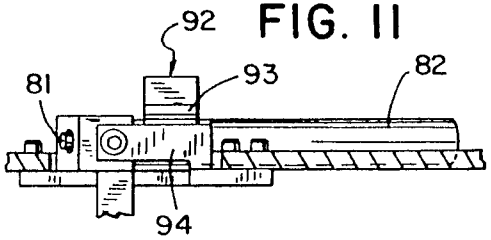
Figure 13:
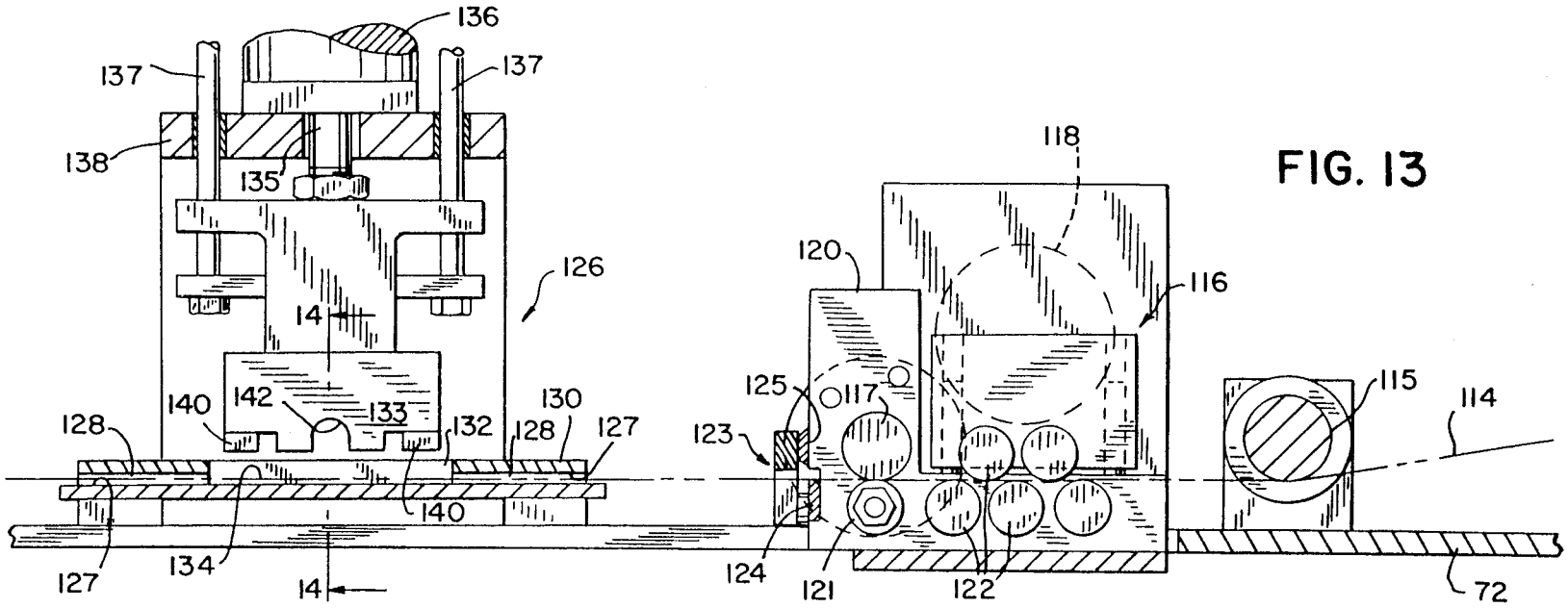
FIGS. 13–15 are elevation views showing details of the ribbon tying mechanism.
Figure 14:
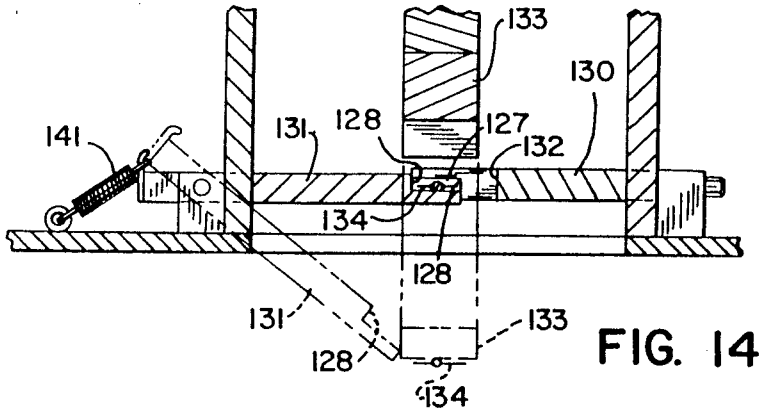
Figure 15:
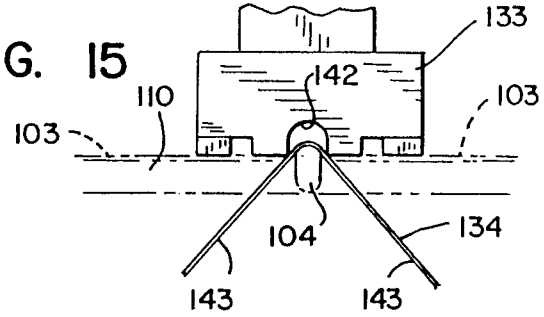

With the holddown rods 84 in the holding position retaining the ribbon material piece 27 against the table top, the opposite ends 87 of the ribbon piece remain supported above the table by the vacuum pick-up heads 74 on the ends of the gantry arm 68. From their held positions, the ribbon ends 87 are then sequentially folded over the holddown rods 84 by a pair of oppositely extending folding rods 88 comprising the cylinder rods of a pair of folding cylinders 90 disposed generally horizontally above the table at a height intermediate the holddown rods 84 and the vacuum pick-up heads 74. Each folding cylinder is positioned laterally adjacent one of the holddown cylinders 82 with its folding rod 88 positioned generally perpendicular to the holddown rod 84 of the adjacent cylinder 82. In their retracted positions, the folding rods 88 are positioned laterally outside of the forming and tying station 13. Each folding rod 88 has a shovel-like guide piece 91 attached to its free end, which guide piece has a flat leading edge approximately equal to the width of the ribbon piece 27. When the folding rod 88 is extended, it engages the underside of one end 87 of the ribbon piece, strips it from the vacuum pick-up head 74, and folds it over the immediately adjacent holddown rod 84, as may be seen schematically in FIGS. 22 and 23. Immediately adjacent the other holddown cylinder 82, a folding clamp 92 is positioned to receive the end 87 of the portion of the ribbon material piece 27 which has been stripped from the vacuum pick-up head 74. Referring also to FIGS. 8, 9 and 11, the folding clamp 92 includes a pivotal upper jaw 93 and a stationary lower jaw 94. The upper jaw comprises part of an upper jaw arm 95 pivotally mounted near its center on a horizontal pivot 96 on one side of the holddown cylinder 82 with the arm 95 extending over the top of the cylinder and terminating in one end at the upper jaw 93. The opposite end of the upper jaw arm 95 is attached to the rod end 98 of a vertically disposed folding clamp cylinder 97. Operation of the folding clamp cylinder 97 causes the upper jaw arm 95 to rotate about its pivot 96, thereby causing the upper jaw 93 to open and close with respect to the stationary lower jaw 94.

Each assembly of a holddown cylinder 82 and folding clamp 92 is attached to a common mounting block 100. The block mounts the holddown cylinder pivot 83 and the folding clamp pivot 96. Further, the mounting block 100 is mounted to slide back and forth a very slight amount in the direction of the length of the ribbon material piece 27. The slight amount of lateral sliding movement causes the two mounting blocks 100 to move toward one another to aid in release of the completed ribbon, as will be described hereinafter. Mounting block movement is provided by a small air cylinder (not shown).

The folding cylinders 90 are operated in sequence to fold one end 87 of the ribbon piece 27 over a holddown rod 84 and into engagement by the folding clamp 92, followed by folding and clamping of the other ribbon end 87. The result, shown schematically in FIG. 24, is a bow preform 101 which is symmetrical about a line of symmetry 102 extending generally perpendicular to the length of the center portion 80 of the ribbon material.

The bow preform 101, which is held in light tension, is then gathered on its center by squeezing it between a pair of opposed horizontal gathering slides 103. The slides squeeze together the center portion 80 of the preform simultaneously with the overlying ends 87, the gathering slides 103 moving linearly on the line of symmetry 102. The result is shown schematically in FIG. 25 where the gathering slides 25 are shown closed to form a center gathered portion 104.

Figure 10:
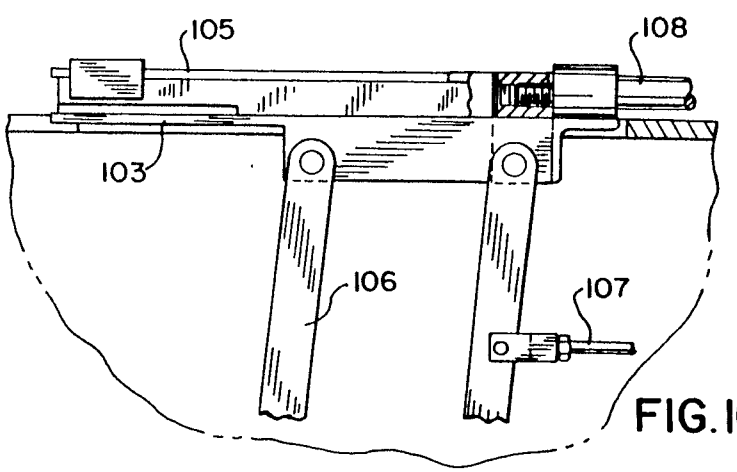
FIGS. 10–12 are vertical sections showing details of the mechanism shown in FIG. 9.

To retain the portion of the bow preform 101 while it is being squeezed between the gathering slides 103 and to prevent the bow material from moving vertically out of the slides as a result of its inherent resilience, one of the gathering slides 103 includes a retaining slide 105 which precedes closing movement of the gathering slides and extends over the center of the bow preform to retain it from vertical movement while the gathering slides 103 close together. Referring generally to FIGS. 1, 9 and 10, each of the gathering slides 103 is supported for sliding movement along the table top on a gathering slide linkage 106 disposed below the table and operated by a horizontally disposed gathering slide cylinder 107. Independent movement of the retaining slide 105, slidably attached to one gathering slide 103, is provided by a horizontally disposed retaining slide cylinder 108 disposed just above the top of the table 14. The retaining slide 105 and the gathering slides 103 have a forked construction when viewed in top plan, so that when the gathering slides 103 are closed and the retaining slide 105 extended thereover, the gathered portion 104 of the bow is held in a vertically open slot 110 (as may best be seen schematically in FIG. 25).

The bow tying mechanism 16 includes an upper assembly 111 for feeding, cutting and delivering a piece of tie wire to a position wrapped around the gathered portion 104 of the bow, and a lower assembly 112 beneath the table top for twisting the ends of the wire tie around the bow. The upper assembly 111 is best seen in FIGS. 1 and 13–15. Referring particularly to FIG. 1, an upper assembly 111 is provided for each forming and tying station 13 and the two assemblies are identical. A spool 113 of tie wire 114 is mounted on one end of the upper frame member 72. The tie wire 114 preferably comprises a steel wire core enclosed by oppositely facing strips of paper or other suitable material. The tie wire 114 is fed from the spool 113 beneath an orienting roll 115 and into a wire feed mechanism 116. The wire feed mechanism includes an upper wire drive wheel 117 driven by an electric motor 118 via a suitable gear box 120. The tie wire 114 is moved tangentially below the drive wheel 117 and held against a lower idler wheel 121. prior to engagement between the drive and idler wheels 117 and 121, the tie wire passes between a series of upper and lower straightening wheels 122. The drive wheel 117 feeds the tie wire 114 horizontally between the open blades of a wire cutoff knife 123. The lower blade 124 is stationary and the upper blade 125 is movable vertically across the face of the lower blade to shear the tie wire.

The tie wire is delivered into a horizontal opening in a wire delivery mechanism 126 which is disposed vertically directly above the forming and tying station 13. The horizontal wire receiving opening 127 is defined by complimentary notches 128 in a stationary upp®r platform 130 and a pivotal lower platform 131. The upper platform 130 includes an open center 132 through which a tie wire delivery head 133 can move vertically to pick up and carry a tie wire piece 134 down to the forming and tying station 13. The tie wire delivery head 133 is mounted to the end of the cylinder rod 135 of a long stroke tie wire delivery cylinder 136. The delivery head 133 and cylinder rod 135 are restricted against rotation on the axis of the cylinder rod by a pair of vertical guide rods 137 attached to the delivery head and slidable in the cylinder mounting bracket 138.

When a tie wire piece 134 of desired length has been fed into the horizontal opening 127 below the delivery head 133, the wire cutoff knife 123 is activated to sever the wire. The delivery head 133 includes a pair of spaced magnets 140 which engage and hold the tie wire piece 134 as the head is moved vertically downwardly through the open center 132 in the upper platform 130. As the delivery head 133 continues to move vertically downwardly, it engages the piVotal lower platform 131, which is normally held closed by a bias spring 141, and causes the lower platform to pivot open for downward passage of the delivery head and attached tie wire piece 134.

The tie wire piece 134 is maintained straight and horizontally disposed against the magnets 140 on the delivery head as the head moves downwardly by extension of the wire delivery cylinder 136. The delivery head 133 is narrow enough to allow it with the attached tie wire piece to enter the open slot 110 defined by the forked ends of the gathering slides 103 and the retaining slide 105 which are closed to hold the gathered portion 104 of the bow. The delivery head 133 includes an inverted U-shaped slot 142 positioned at the center thereof and at the center of the tie wire piece 134. As the delivery head and tie wire piece enter the open slot 110 in the tying station 13, the tie wire piece 134 engages the gathered portion 104 of the bow, and continued downward movement of the delivery head causes the tie wire piece to be bent around the gathered portion 102 and to be received in the slot 142. Downward movement of the delivery head is halted when the tie wire piece and gathered portion of the bow are fully received in the slot 142 and the ends of the wire piece are bent toward each other to form the parallel legs 143 of an inverted U-shape, as shown schematically in FIG. 27. The legs 143 of the tie wire piece extend downwardly below the table top where they are engaged by the jaws 144 of a twist clamp 145.

Referring also to FIG. 8, the twist clamp jaws 144 are pivotally attached at their lower ends by a jaw pivot 146 on clamp platform 147. The jaws 144 are moved between their open position (FIG. 27) and their closed position (FIGS. 8 and 28) by a pair of twist clamp cylinders 148, each attached by its cylinder end 150 to the clamp platform 147 and by its rod end 151 to the clamp jaw 144. The entire subassembly comprising the clamp jaws 144, clamp platform 146 and clamp cylinders 148 is supported on a vertical support pin 153 mounted for rotation in a bearing 152 positioned beneath the platform 147. The lower end of the support pin 153 has mounted thereon a pinion 154 which is engaged by a horizontally reciprocating rack 155 to cause rotation of the pinion and consequent rotation of the entire twist clamp subassembly. The rack 155 is operated by a horizontal twisting cylinder mounted on the lower frame member 157. When the legs 143 of the tie wire piece are clamped between the jaws of the twist clamp 145, rotation of the twist clamp on the axis of the support pin 153 will cause the ends of the wire piece to be twisted together, thereby completing assembly of the bow. It should be pointed out that the twist clamp jaws 144 are shown rotated 90° in FIGS. 1 and 8 from their normal clamping position shown in FIG. 28. Thus, the twist clamp jaws 144 normally articulate between their opened and closed positions in a vertical plane through the open slot 110 on the line of symmetry 102 through the bow.

When the bow has been completed by twisting the ends of the tie wire piece together, the gathering slides 103 and retaining slide 105 of the gathering mechanism are opened, the delivery head 133 is withdrawn upwardly, the twist clamp 145 is opened, the holddown cylinders 82 are moved a short distance toward one another and the cylinder rods 84 retracted, and the clamping fingers 158 of the pick and place robot 17 are extended downwardly and caused to grasp the tied bow about the gathered center portion 104 for delivery to its associated discharge conveyor 18. Each pick and place robot 17 is attached to one end of the gantry platform 12 and clamping fingers 158 are attached to the extendible end of a robot cylinder rod 160.

The apparatus of the preferred embodiment, including identical stations each comprising a forming and tying station 13, a wire feed mechanism 116 and a wire delivery mechanism 126, allows the ribbon deliVery and cutting mechanism 10 and the various mechanisms attached to the gantry platform 12 to simultaneously serve both forming and tying stations 13 in different phases of their operations. Thus, while a ribbon material piece 27 is being delivered on the gantry arm 68 to one forming and tying station 13, the bow previously tied at that station is being delivered to the discharge conveyor 18 by the robot 17, a tie wire piece 134 is being delivered to the other forming and tying station 13, and the next ribbon material piece 27 is being cut in the cutting mechanism 10 With the gantry arm 68 and attached vacuum pick-up heads 74 positioned centrally at the ribbon delivery and cutting station 10, a newly cut ribbon material piece 27 is picked up simultaneously with the pick up of a finished bow by the pick and place robot 17 at one forming and tying station 13. As the finished bow is carried on the gantry platform 12 toward the discharge conveyor 18, the newly cut ribbon piece 27 is delivered by the gantry arm 68 to the station from which the finished bow has just been removed. Folding and gathering of the newly cut ribbon piece occurs immediately after it arrives at the forming and tying station 13 and, at the same time, a tie wire piece 134 is being applied to the folded and gathered bow preform at the opposite station.

Various modes of carrying out the present invention are contemplated as being within the scope of the following claims particularly pointing out and distinctly claiming the subject matter which is regarded as the invention.

I claim:

1. An apparatus for forming and tying a decorative bow from a piece of ribbon material of selected length cut from a strip of ribbon material comprising:

a ribbon tranfer meachanism including:

means for releasably holding the piece of ribbon material by its ends over the top of a table with the piece relaxed lengthwise to form a downwardly sagging center portion;

a ribbon folding and gathering mechanism including:

means including a pair of spaced holddown members extendable over the sagging center portion for holding the center portion against the table top inwardly of the ends of the piece;

means for stripping the held ends of the material piece from the end holding means and for folding each end over its respectively adjacent holddown member and the center portion of the piece with one end of the piece overlying the other, said ends disposed in generally opposite directions and each end disposed at an angle with respect to the length of the ribbon;

means for grasping the folded ends to hold the folded piece in tension to form a bow preform;

means for gathering the bow preform by squeezing the overlying ends and the center portion horizontally over the table top on a line generally perpdendicular to the length of the center portion to form a short pinched portion of material; and, a ribbon tying mechanism including:

means for feeding one end of a strip of tie wire from a tie wire source;

means for cutting a piece of tie wire of selected length from the end of the strip;

means for wrapping the tie wire piece around the pinched portion of ribbon material to bring the wire ends towards one another beneath the table top with the wire ends forming the legs of an inverted U-shape;

means for clamping the legs of the wire piece together including clamping jaws positioned beneath the table top and closely adjacent the pinched portion; and, means for turning the clamping jaws on a vertical axis extending through the jaws to twist the legs of the wire piece together to hold the pinched portion tightly in place.

2. The apparatus as set forth in claim 1 comprising:

a ribbon delivery and cutting mechanism including:

means for drawing one end of the strip of ribbon material from a ribbon material source; and, means for cutting the piece of ribbon material from the end of the strip.

3. The apparatus as set forth in claim 2 wherein said ribbon transfer mechanism comprises:

a gantry platform positioned above the table top for linear reciprocal horizontal movement in a direction transverse to the length of the piece of material; and, said means for releasably holding the piece of material includes a gantry arm attached to and movable with the platform, said gantry arm disposed parallel to the length of the piece of material;

said gantry arm having a vacuum pick-up head attached to each end for vertical reciprocal movement above the cutting mechanism to pick up and hold the piece of material above the table top;

said vacuum pick-up heads being further movable along the arm toward each other to collapse said piece and form said downwardly sagging center portion.

4. The apparatus as set forth in claim 3 comprising:

two pairs of mechanisms, each including a ribbon folding and gathering mechanism and a ribbon tying mechanism, each pair of mechanisms disposed on opposite side of said ribbon delivery and cutting mechanism; and, said gantry arm movable alternately in opposite directions between said ribbon delivery and cutting mechanism and each of said pairs of mechanisms to deliver alternately cut pieces of ribbon material thereto.

5. The apparatus as set forth in claim 4 wherein said material cutting means comprises knife means alternately positionable with each opposite directional movement of said gantry arm for cutting said strip of ribbon material on alternately biased cut lines.

6. The apparatus as set forth in claim 1 wherein said means for holding the center portion of the piece of material comprises:

a pair of fingers forming the holddown members, said fingers having axes rotatable in a vertical plane between an upwardly angled material receiving position and a lower horizontal holding position; and, said fingers being relatively movable horizontally with respect to the means for releasably holding the piece of material to override the sagging center portion in the material receiving position and to hold said center portion against the table in the holding position.

7. The apparatus as set forth in claim 6 wherein:

said fingers are positioned to converge in the direction of their distal ends to lie at acute angles with respect to the length of the material piece;

said means for stripping and folding comprises a horizontally reciprocable folding arm for each holddown finger, positioned to move over and generally transversely of the finger and to strip one held end of the material piece from the holding means and carry the end toward a proximal end of the other holddown finger; and, said grasping means comprises a clamping jaw for each folding arm, said jaw positioned adjacent the proximal end of said other holddown finger to receive and clamp the free end of the material piece end carried by said folding arm.

8. The apparatus as set forth in claim 1 wherein said means for gathering comprises:

a pair of opposed gathering members positioned to move along the table top on a line of symmetry through the bow preform to a closed position to form said pinched portion; and, a retaining member on one of said gathering members and movable on the line of symmetry independently of said one gathering member to override and vertically contain the ends and center portion of the preform prior to movement of the gathering members to the closed position.

9. The apparatus as set forth in claim 1 wherein the tie wire includes a ferrous wire and said ribbon tying mechanism comprises:

said wrapping means including magnetic pick-up for holding the wire tie piece above the pinched portion of the bow preform with the wire tie piece disposed in the vertical plane through a line of symmetry of the bow preform, said pick-up movable vertically downward to carry the wire tie piece between said gathering means and into wrapping contact with the pinched portion.

10. The apparatus as set forth in claim 9 wherein said magnetic pick-up includes a centrally disposed U-shaped forming notch into which the wire tie piece is forced in response to movement into contact with the pinched portion.

11. A method of forming and tying a decorative bow from a piece of ribbon material of a selected length comprising the steps of:

1.) holding the piece of ribbon material lengthwise by its ends over the top of a table with one piece relaxed to form a downwardly sagging center portion;

2.) separately holding the center portion against the table top with a pair of spaced holddown members inwardly of the ends of the piece;

3.) stripping the held ends of the material piece and folding each end over its respectively adjacent holddown member in generally opposite directions, each disposed at an angle with respect to the length of the ribbon;

4.) grasping the folded ends to hold the folded piece in tension;

5.) gathering the folded piece at its center by squeezing the ends and center portion horizontally over the table top on a line generally perpendicular to the length of the center portion to form a short pinched portion of material;

6.) drawing one end of a strip of tie wire from a tie wire source;

7.) cutting a piece of tie wire of selected length from the end of the strip;

8.) folding the tie wire piece around the pinched portion of ribbon material by moving the wire piece vertically downward and bending the ends of the wire piece to bring the wire ends toward one another beneath the table top, the wire ends forming the legs of an inverted U-shape;

9.) clamping the legs of the wire piece together with clamping jaws positioned beneath the table top and closely adjacent the pinched portions; and, 10.) turning the clamping jaws on a vertical axis through the jaws to twist the legs of the wire piece together to hold the pinched portion tightly in place.

12. The method as set forth in claim 1 including the preliminary steps of:

1.) drawing one of a strip of ribbon material from a ribbon material source; and, 2.) cutting the piece of ribbon material of a selected length from the end of the strip.

* * * * *